United States Patent [19]

Moehling

[11] Patent Number: 4,811,668

[45] Date of Patent: Mar. 14, 1989

[54] THREE AXLE RAILWAY TRUCK

[75] Inventor: Charles Moehling, Arlington Heights, Ill.

[73] Assignee: Amsted Industries Incorporated, Chicago, Ill.

[21] Appl. No.: 145,260

[22] Filed: Jan. 19, 1988

[51] Int. Cl.[4] ..... B61F 5/00; B61D 17/00

[52] U.S. Cl. ..... 105/4.1; 105/196; 105/206.1; 105/226

[58] Field of Search ..... 105/4.1, 4.2, 176, 182.1, 105/195, 196, 206.1, 202, 226, 227, 228, 188, 166, 199.1, 199.3

[56] References Cited

U.S. PATENT DOCUMENTS

| | | | |
|---|---|---|---|
| 424,062 | 3/1890 | Hazard | 105/4.1 |
| 1,749,715 | 3/1930 | Orr | 105/195 |
| 3,041,985 | 7/1962 | Brill et al. | 105/4.1 X |
| 3,220,357 | 11/1965 | Tack | 105/226 X |
| 3,361,085 | 1/1968 | Bexon et al. | 105/228 X |
| 3,447,484 | 6/1969 | Stein | 105/196 X |
| 3,961,582 | 6/1976 | Paton et al. | 105/176 X |
| 4,593,829 | 6/1986 | Altherr | 105/4.1 X |

FOREIGN PATENT DOCUMENTS

| | | | |
|---|---|---|---|
| 1455170 | 2/1969 | Fed. Rep. of Germany | 105/4.1 |
| 1292157 | 4/1969 | Fed. Rep. of Germany | 105/4.1 |

*Primary Examiner*—Johnny D. Cherry
*Assistant Examiner*—Joseph D. Pape
*Attorney, Agent, or Firm*—Edward J. Brosius; Charles E. Bouton

[57] ABSTRACT

The present invention provides a three axle railway truck. The truck comprises three wheelsets supporting two parallel sideframes. Each sideframe comprises two sections. One wheelset is located near the longitudinal middle of the sideframes, with the two other axle wheelsets located near either end of the sideframes. Two bolsters extend laterally across between these sideframes, with each bolster located between the center axle and an end axle. The bolster ends are received in pockets in the sideframes. Each bolster has a centerplate structure receiving a pin as part of an articulated connection spanning between and connecting the bolsters.

11 Claims, 4 Drawing Sheets

THREE AXLE RAILWAY TRUCK

BACKGROUND OF THE INVENTION

The present invention relates to railway trucks and, more particularly, to a three axle railway truck.

Increased utilization of stacked container cars has lead to the realization that existing two axle freight car truck designs do not have adequate capacity to accommodate two or more containers loaded to their maximum allowable capacity. An alternative truck design, which solves many of the capacity problems, is the three axle truck. However, existing designs of three axle trucks present several problems relative to their accommodation under the railway car body. These designs of three axle trucks (shown generally in FIG. 1 of the drawings) have a centrally located centerplate on a single, large bolster casting, which in the case of well type stacked container cars, complicates car body construction requiring extensive overhang beyond the well. This not only increases the strength requirements for this portion of the car structure, but also adds weight to the car body. Such prior art three axle truck designs have four sideframes (two per side) which are joined over the center axle. The massive single piece bolster is supported by spring groups at each of the four sideframes wherein ends of the bolster extend. The single centerplate is flanked by raised side bearing pads all of which are positioned over the center axle. Such three axle truck designs are difficult and expensive to cast due to the overall size, complexity and weight of the bolsters. Alignment of the four bolster ends requires extensive gauging procedures and adjustment using plates and welding. The rigidity of the bolster with respect to the four ends results in a deterioration in the trucks equalization capabilities, a condition which contributes to derailment. The complexity of the brake rigging is a further problem and creates a significant maintenance item.

The present invention provides a three axle truck with the necessary load carrying capacity for the containerized applications and other uses. The truck is equipped with two bolsters each having a centerplate and side bearing supports. The centerplate and side bearing supports are located longitudinally on the truck somewhat near the end axle wheelsets to help decrease the length of car body overhang required to interface with the truck and to distribute the load to the axles so as to not overload the center axle. Further, articulated connectors are utilized to join the car body to the truck. A typical articulated connector is shown in U.S. Pat. No. 4,593,829, assigned to the assignee of the present case. In the particular arrangement of the present invention, a simulated car body center sill structure is utilized to join the two connectors at each bolster. This center sill passes over the center axle of the truck and provides a load path for the longitudinal train forces. To simplify car and truck assembly, the articulated connector's female connection is attached to the car body and the male connection to the simulated center sill. Other combinations of connections in car bodies are possible to accommodate specific car construction needs. Further, the simulated center sill can be replaced by any structure which can provide the longitudinal load path between the centerplates.

Each car body centerplate rests on individual truck bolsters, each with its own set of load springs and truck snubbing elements in the sideframe bolster opening. The truck bolster structure is simplified from the single bolster structure of the prior art by eliminating the need to carry the load at a central point. Further, the articulated connection and center sill are adapted to carry the buff or compression and draft or pulling train forces.

DESCRIPTION OF THE PREFERRED EMBODIMENT

Figure 1:
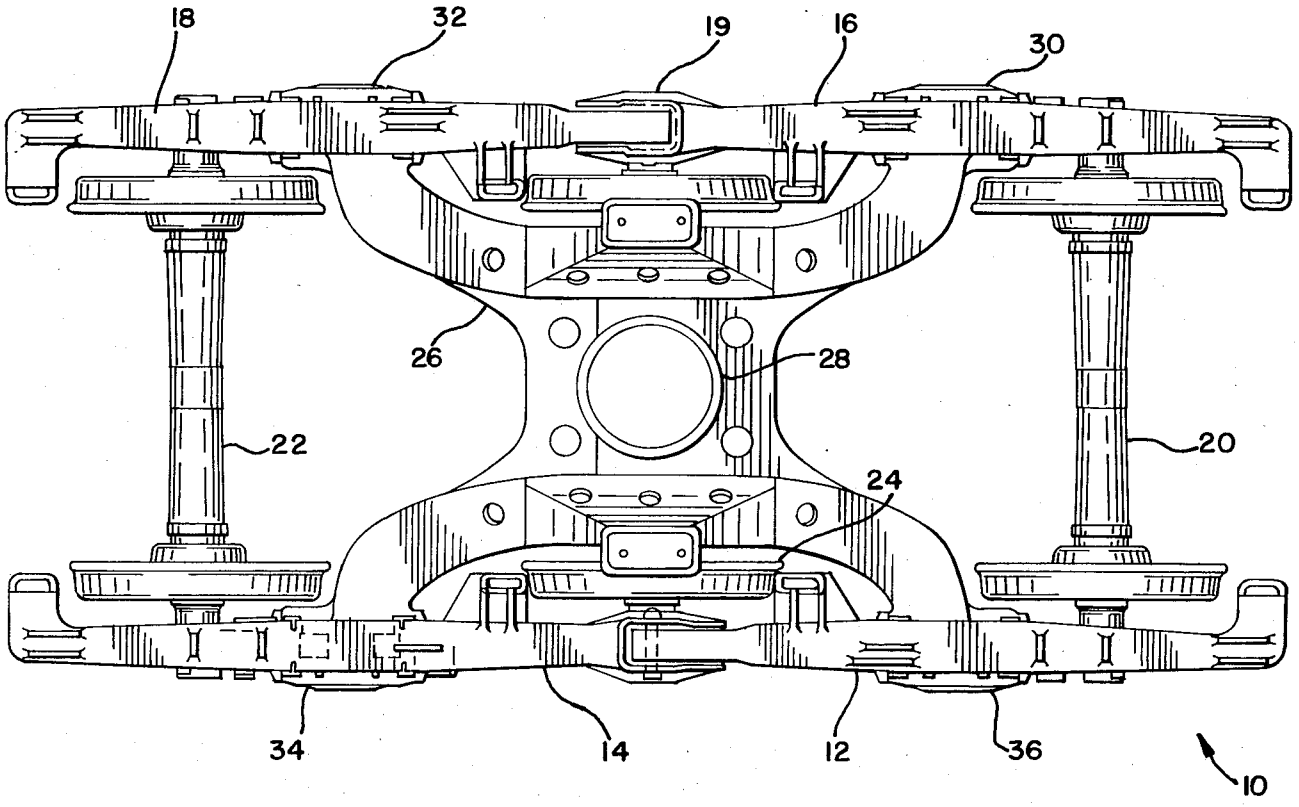
FIG. 1 PRIOR ART
FIG. 1 is a top view of a prior art single bolster, three axle railway truck.

Referring now to FIG. 1, a prior art three axle truck is shown generally at 10. Truck 10 comprises two parallel sideframe assemblies one of which includes sections 12 and 14 and the opposite side of which comprises sections 16 and 18. The sideframe sections are joined by a bolting and bearing block mechanism along midpoint 19 of truck 10. Truck 10 further includes end axle wheelsets 20 and 22 and center axle and wheelset 24. Center axle 24 is generally in longitudinal alignment with midpoint 19 of truck 10. Bolster 26 includes four ends 30, 32, 34 and 36 which are received in bolster openings in sideframe sections 16, 18, 14 and 12, respectively. Bolster 26 also includes a single centrally located centerplate 28 which is also aligned with the longitudinal center line 19 of truck 10.

Figure 2:
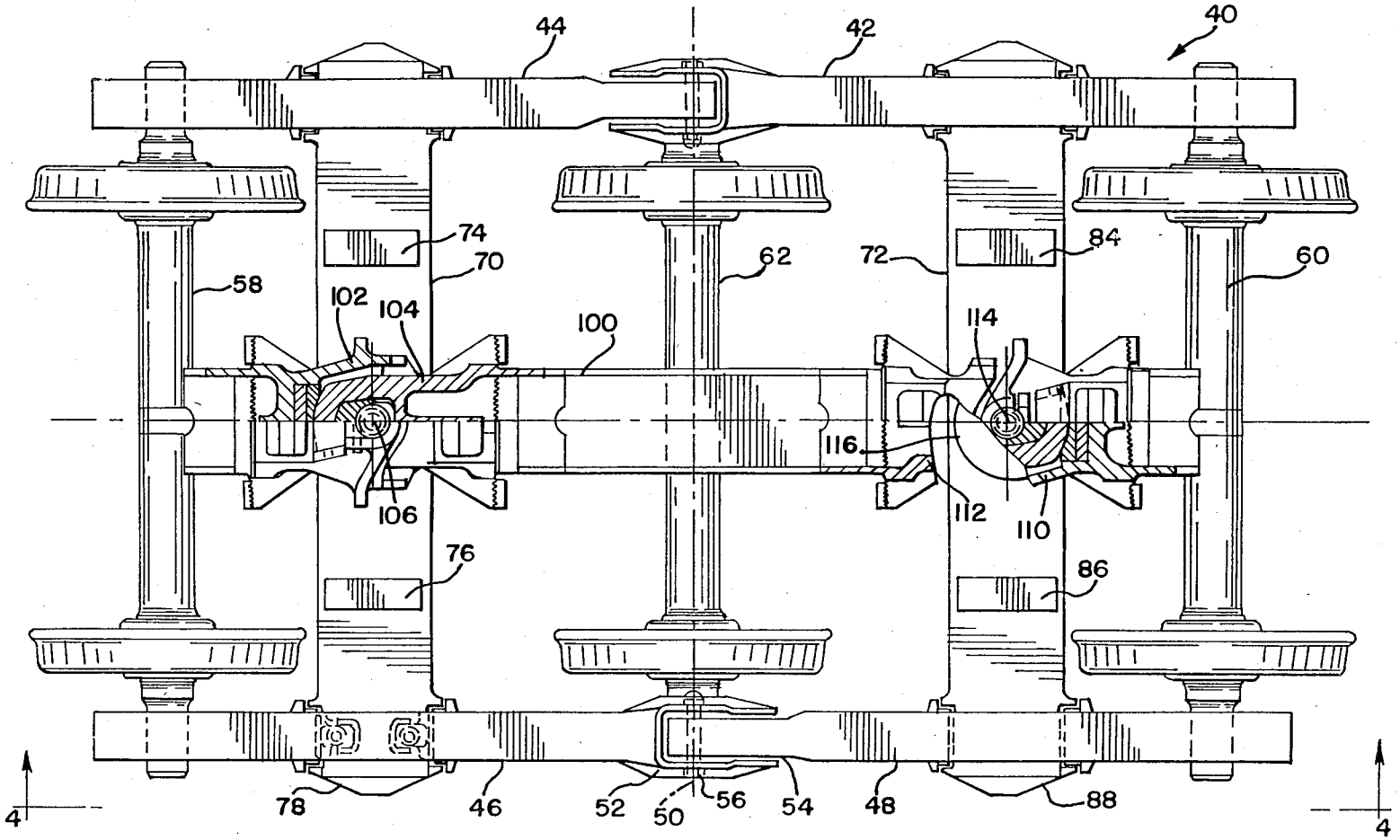
FIG. 2 is a top view in partial cross section of a three axle railway truck in accordance with the present invention.
Figure 3:
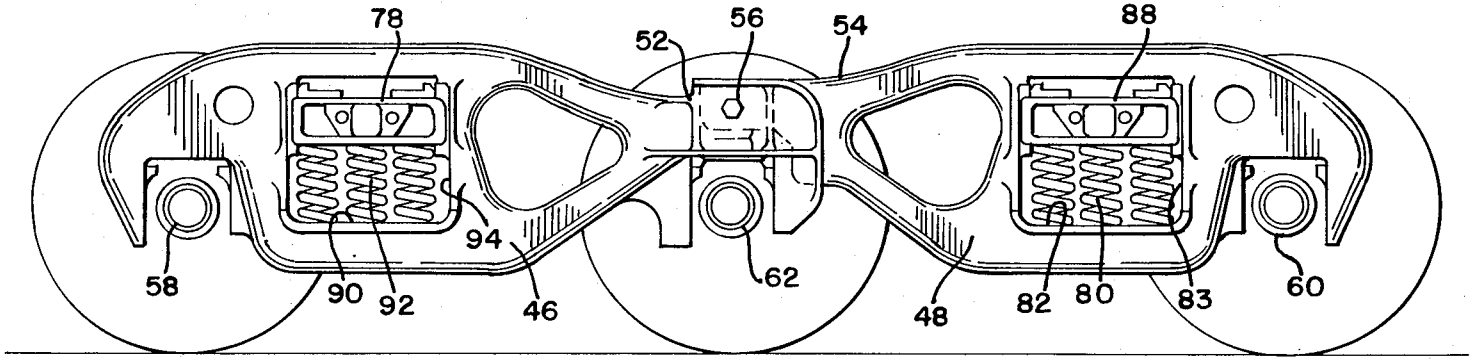
FIG. 3 is a side view of a three axle railway truck in accordance with the present invention.

Referring now to FIG. 2, a three axle railway truck in accordance with a first embodiment of the present invention is shown generally at 40. Truck 40 is comprised of two parallel sideframe assemblies, one of which includes sections 42 and 44 and the other of which includes sections 46 and 48. Each sideframe section is an elongated, generally rectangular cast metal construction. A longitudinal center line of truck 40 is shown at 50. Sideframe section 46 includes an open receiving end 52 into which an extended end section 54 of sideframe section 48 projects. The two sections are joined by a bolt and bearing block assembly 56. Sideframe sections 42 and 44 are joined similarly. Three axle wheelset assemblies extend laterally between the sideframes. End axle wheelset 58 is received in bearing receptacles near the ends of sideframe sections 44 and 46. End axle wheelset 60 is received at the opposite end of truck 40 in bearing receptacles near the ends of sideframe sections 42 and 48. Center axle wheelset 62 is longitudinally aligned with center line 50 of truck 40 and is received in a bearing receptacle located below the end joined sections 52 of sideframe section 46 and 54 of sideframe section 48, as well as corresponding sections of sideframe sections 42 and 44. Referring to FIG. 3, a side view of sideframe sections 46 and 48 is presented wherein the relative locations of axle wheelsets 58, 60 and 62 is readily seen as is the connection of sideframe extensions 52 and 54 by bolt and bearing block 56.

In FIG. 2, an elongated generally rectangular cast metal bolster 70 extends between sideframe sections 44 and 46. Each end of bolster 70 is received in an opening in each respective sideframe, with bolster end 78 shown in FIG. 3 as extending into sideframe opening 94. Bolster end 78 is supported on springs 92 which themselves rest upon spring support section 90 which forms the bottom of sideframe opening 94. Side bearings 74 and 76, shown in FIG. 2, are located inboard from sideframes 44 and 46, respectively. Side bearings 74 and 76 aid in reducing side to side motion or rock and roll motion of the freight car.

A similar bolster 72 extends between sideframe sections 42 and 48. Each end of bolster 72 is received in a sideframe opening, with bolster end 88 shown in FIG. 3 as extending into sideframe opening 83 and supported on springs 80 which themselves rest on bottom section 82 of sideframe opening 83. Side bearings 84 and 86, shown in FIG. 2, are located inboard from sideframes 42 and 48, respectively.

Note that bolster 70 is located between end axle 58 and center axle 62, with bolster 70 being physically closer to end axle 58. Similarly, bolster 72 is located between end axle 60 and center axle 62, while bolster 72 is physically closer to end axle 60.

Elongated, generally rectangular center sill 100 acts as a connecting device between bolsters 70 and 72. One end of center sill 100 terminates in a male articulated connector end 102 which is received in an opening of the female articulated connector end 104. A pin 106 extends from an opening in the bolster 70 centerplate, and pin 106 is received in receiving openings in articulated connector ends 102 and 104. The other end of center sill 100 also terminates in a male articulated connector end 110, which itself is received in an opening of female articulated connector end 112. Pin 114 extends from an opening in bolster 72 centerplate 116 upwardly into receiving openings in articulated connectors 110 and 112. Accordingly, either female articulated connector 104 or 112 may extend outwardly to a car center sill.

Figure 4:
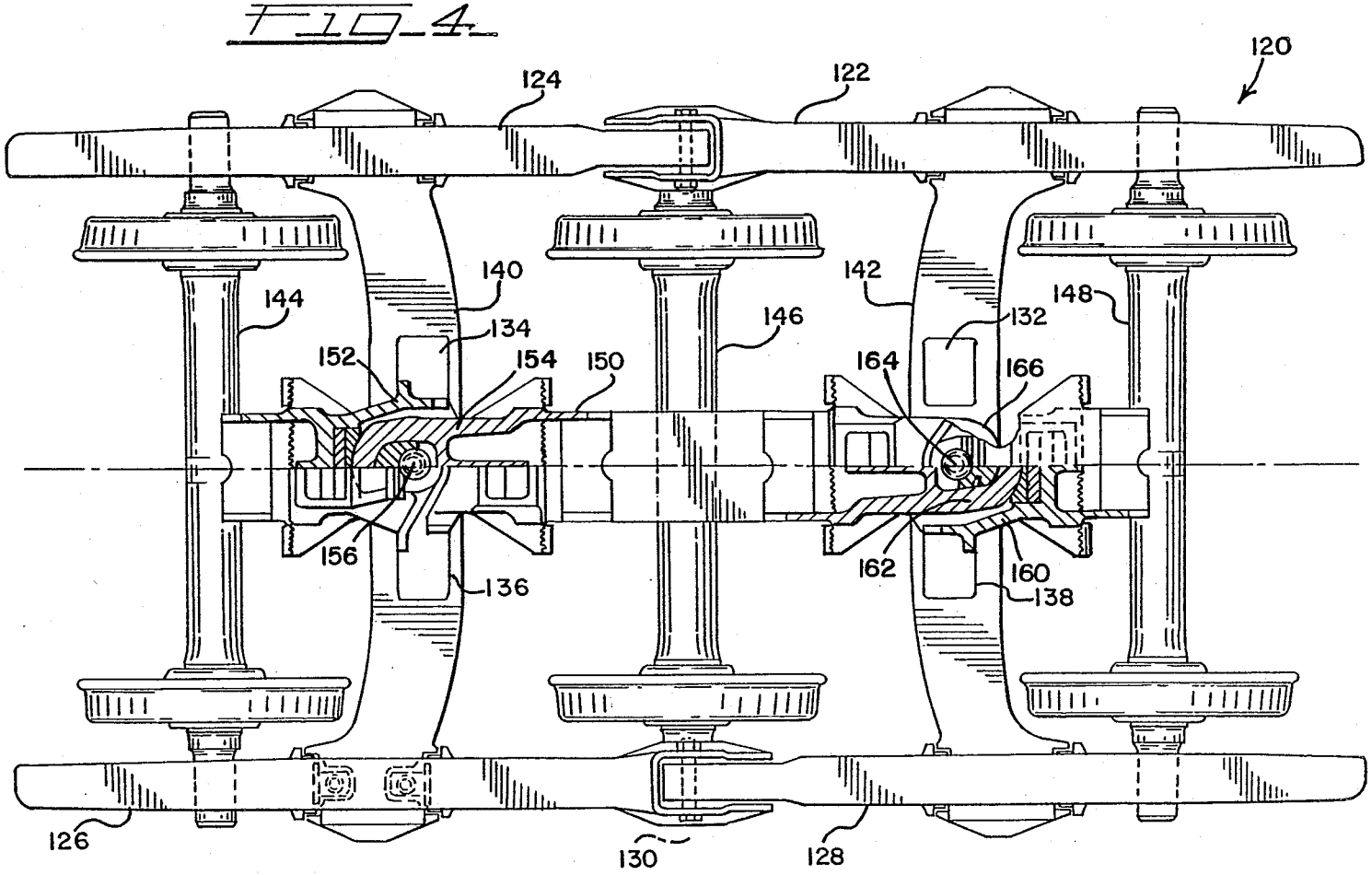
FIG. 4 is a top view of a three axle railway truck in accordance with the present invention.

Referring now to FIG. 4 of the drawings, a second embodiment of a three axle railway truck in accordance with the present invention is shown generally at 120. Truck 120 comprises two parallel sideframes, one of which is comprised of sections 122 and 124 and the other of which is comprised of sections 126 and 128. The sideframe sections are joined along truck longitudinal center line 130 in the same manner as the first embodiment shown in FIG. 2. Three axles, including end axles 144 and 148 and center axle 146 extend laterally between the sideframes.

Bolster 140 is an elongated, somewhat curved section extending between sideframe sections 124 and 126. End sections of bolster 140 are received in openings in sideframe sections 124 and 126, wherein the end bolster sections are supported on spring groups similar to that described in FIG. 2. Bolster section 142 is an elongated somewhat curved section extending laterally between sideframe sections 122 and 128. End sections of bolster 142 are received in openings in sideframes 122 and 128 and are supported on spring groups similar to that described in FIG. 2.

Center sill 150 is an elongated, generally rectangular cast metal device extending longitudinally between bolsters 140 and 142. One end of center sill 150 terminates in a male articulated connector end 152, which is an opening of female articulated connector end 162. Coupler pin 164 extends upwardly from an opening in centerplate 166 of bolster 142.

The female articulated connector ends 154 and 162 extend outwardly to the center sill structure of the car supported by truck 120. In this manner, compressive or buff forces and pulling or draft forces are transmitted from the connecting device through truck 120 to the car sill.

As seen in FIG. 4, side bearing pad 132 extends as a generally rectangular, raised section from the top of bolster 142 adjacent one side of male articulated connector end 160. A similar side bearing pad extends from the top of bolster 142 adjacent the other side of male articulated connector end 160. Two similar side bearing pads extend from the top of bolster 140.

Male articulated connector 160 includes a side bearing extension 138 protruding outwardly from the side of the connector end toward sideframe 128. Side bearing extension 138 is a generally planar, rectangular protrusion that extends over the side bearing pad below on bolster 142. A similar side bearing extension protrudes from the other side of male articulated connector 160, but is cut away in FIG. 4 to show side bearing pad 132 therebelow. Similar side bearing extensions 134, 136 protrude from the sides of male articulated connector 152 above side bearing pads on bolster 140. Such side bearing extensions and pads provide stability to the car body in lessening the potential for car body rock from side to side on the truck.

I claim:

1. A railway car truck comprising two generally parallel sideframes at lateral edges of said truck, three axles extending laterally between said sideframes with a wheel affixed near each axle end, a center one of said axles extending laterally at about the longitudinal center line of said sideframes, two bolsters each extending laterally between said sideframes and located longitudinally between the one center axle and an outer axle, a centerplate at a lateral center point of each of said bolsters, connecting means extending between said bolster centerplates, said connecting means including a shank portion and two end portions, and pin means extending to said bolster centerplate received in each said connecting means end portion.

2. The railway car truck of claim 1 wherein each of said connecting means end portions comprises one end of an articulated connector.

3. The railway truck of claim 1 wherein each of said bolsters is of an elongated generally rectangular configuration, and extends essentially laterally between two bolster openings in said sideframes.

4. The railway truck of claim 1 wherein each of said sideframes is comprised of two sections, each of said sections being of a generally elongated rectangular shape and being joined at adjacent ends of said side- 6. The railway truck of claim 4 wherein each of said sideframe sections includes an end bearing opening receiving an axle end.

7. The railway car truck of claim 2 wherein each end of the articulated connector includes sidewalls having side bearing extensions protruding therefrom, and each bolster includes an upper surface having side bearing pads thereon.

8. A railway truck comprising two parallel side frames, two end axles extending between said sideframes near the ends thereof and a center axle extending between said sideframes at about the longitudinal midpoint thereof, two bolsters extending between said sideframes, each bolster located longitudinally between one of said end axles and said center axle, each side frame having bolster openings receiving an end of one of said bolsters, a connecting means between said bolsters, wherein said connecting means comprises a shank having two ends each of which terminates at one of said bolsters, each of said bolsters having a center pocket and a pin received therein, each end of said shank being received in said center pocket and receiving said pin.

9. A railway truck comprising two parallel sideframes, two end axles extending between said side frames near the ends thereof and a center axle extending between said sideframes at about the longitudinal midpoint thereof, two bolsters extending between said side frames each bolster located longitudinally between one of said end axles and said center axle, each sideframe having bolster openings receiving an end of one of said bolsters, a connecting means between said bolsters, wherein said connecting means comprising a center pocket in each bolster and a shank having two ends, each end forming part of an articulated connector and being received in the center pocket in a respective one of said bolsters.

10. The railway truck of claim 9 comprising a pin received in each of said center pockets, and wherein each said pin is received in one of said articulated connectors.

11. The railway truck of claim 9 wherein each end of the articulated connector includes sidewalls having side bearing extensions protruding therefrom, and each bolster includes an upper surface having side bearing pads thereon.

* * * * *